US005111776A

United States Patent [19]

Matsushiro et al.

[11] Patent Number: 5,111,776

[45] Date of Patent: May 12, 1992

[54] COOLING SYSTEM FOR AN INTERNAL COMBUSTION ENGINE

[75] Inventors: Ryuichi Matsushiro; Toru Kosuda, both of Okazaki; Shigeo Sasao, Nishio; Taro Ikeya, Okazaki; Yoshiharu Chino; Yasuaki Uekawa, both of Toyota, all of Japan

[73] Assignees: Nippon Soken, Inc., Nishio; Toyota Jidosha Kabushiki Kaisha, Toyota, both of Japan

[21] Appl. No.: 587,940

[22] Filed: Sep. 25, 1990

[30] Foreign Application Priority Data

Sep. 26, 1989 [JP] Japan ..... 1-248049

[51] Int. Cl.[5] ..... F01P 3/22

[52] U.S. Cl. ..... 123/41.54; 123/41.29

[58] Field of Search ..... 123/41.08, 41.15, 41.27, 123/41.29, 41.51, 41.54

[56] References Cited

U.S. PATENT DOCUMENTS 4,352,342 10/1982 Cser et al. ..... 123/41.54
4,473,037 9/1984 Michassouridis et al. ..... 123/41.54
4,510,893 4/1985 Schweiger et al. ..... 123/41.27

FOREIGN PATENT DOCUMENTS 3045357 6/1982 Fed. Rep. of Germany ... 123/41.54
2250381 5/1975 France ..... 123/41.54
52-90654 12/1975 Japan .
56-99009 12/1979 Japan .
59-81985 11/1982 Japan .
60-15922 7/1983 Japan .
62-88829 11/1985 Japan .

*Primary Examiner*—Noah P. Kamen
*Attorney, Agent, or Firm*—Cushman, Darby & Cushman

[57] ABSTRACT

A sealed type engine cooling system having a reservoir tank connected to the engine recirculating water passageway by inlet pipes connected to the upper outlet of an engine cooling water passageway and to the upper inlet of a radiator. The bottom portion of the reservoir tank is connected to the bottom of the engine cooling water passageway, for supplementing the engine cooling water, and is provided with a cap with a relief valve, to thereby discharge vapor created in the cooling water passageway under a hot soak condition. The relationship between the inner diameter of the pipes is such that the effective cross sectional area of the inlet pipe means is 1.5 to 3 times larger than the effective cross sectional area of the outlet pipe means, or the inlet pipe is arranged so that a minimum distance is obtained between the engine upper portion and the radiator, or a check valve is arranged in the outlet pipe, or the space inside the reservoir tank is partitioned into chambers, and the inlet and outlet pipes are connected to separate chambers.

10 Claims, 6 Drawing Sheets

COOLING SYSTEM FOR AN INTERNAL COMBUSTION ENGINE

BACKGROUND OF THE INVENTION

1. Field of the Invention

The present invention relates to a cooling system for a water-cooled type of internal combustion engine, and in particular, to a sealed cooling water recirculation system using a reservoir tank.

2. Description of the Related Art

In a known cooling system for an internal combustion engine, a cooling water reservoir tank is provided and is used not only for storing an overflow of cooling water but also for ensuring a recirculation of a part of the cooling water to the reservoir tank, to thereby separate and remove air and vapor from the cooling water in the reservoir tank, whereby the cooling efficiency of the cooling system is increased. (See Japanese Unexamined Utility Model Publication No. 52-90654, Japanese Unexamined Utility Model Publication No. 60-15922, Japanese Unexamined Utility Model Publication No. 62-88829, Japanese Unexamined Utility Model Publication No. 56-99009, and Japanese Unexamined Utility Model Publication No. 59-81985.)

In this type of cooling system, in general, an independent cooling water passageway connects the reservoir tank to an engine body and a radiator, and the reservoir tank is provided with a cap equipped with a relief valve which allows air or vapor held in an upper portion of the reservoir tank to be discharged to the atmosphere, when the pressure inside the reservoir tank exceeds a predetermined value, and thus prevents an excessive increase of the pressure in the cooling system. This operation also allows air to be quickly separated from the cooling water: this air is entrained in the cooling system when the cooling water is supplemented, and remains in the cooling system. The separated air is discharged by the relief valve in the reservoir tank, and thus the cooling efficiency of the system is enhanced.

When the engine is stopped just after a high load operation, the circulation of the cooling water is stopped, and accordingly, the temperature of the cooling water becomes very high, which causes a large amount of the cooling water to be vaporized, and this vapor collects in the upper portion of the cooling system (i.e., a hot soak). In the prior art construction, it is difficult to quickly remove the vapor, since the pipe connecting the upper portion of the cooling water jacket of the engine to the reservoir tank runs vertically downward from the reservoir tank and then upward to a union with the water jacket of the engine, and as a result, a vapor lock often occurs in a portion of the pipe just after the hot engine is stopped. This vapor lock in the engine cooling water system causes a reverse flow of the cooling water in the engine toward the reservoir tank, and the excess cooling water in the tank overflows to the outside via the relief valve.

This loss of the cooling water will, of course, lower the cooling efficiency and reduce the reliability of the device, since essentially the object of the sealed type cooling system provided with the reservoir tank is to eliminate the need to supplement the water in the system.

SUMMARY OF THE INVENTION

Therefore, an object of the present invention is to provide an improvement of the sealed type cooling system, by which the above-mentioned drawback is overcome.

According to the present invention, there is provided a cooling system for an internal combustion engine comprising: a radiator having an inlet at a top portion and an outlet at a bottom portion thereof; the engine being provided with an inner cooling water passageway having an inlet at a bottom portion and an outlet at a top portion thereof; main pipes connecting the inlet and outlet of the inner cooling water passageway to the outlet and inlet of the radiator, respectively, to thereby create a recirculating passageway by which a recirculation of the cooling water between the radiator and the engine is ensured; a reservoir tank for storing an amount of cooling water for supplementing the engine cooling water recirculating line therewith, the reservoir tank being equipped at an upper portion thereof with a relief valve for discharging water vapor and entrained air to the atmosphere; at least one inlet pipe connecting the upper portion of the reservoir tank to an upper portion of the recirculating passageway; an outlet pipe connecting the lower portion of the reservoir tank to a lower portion of the recirculating passageway; and means for allowing a quick removal to the atmosphere of vapor pressure generated in the recirculation passageway, via a relief valve of the reservoir tank during an engine high temperature condition, to thereby prevent a reverse flow of the engine cooling water to the reservoir tank via the outlet pipe due to a vapor lock in the recirculating passageway.

According to one embodiment of the present invention, first and second inlet pipes connect the reservoir tank to the outlet of the engine inner passageway and the inlet of the radiator, respectively, and the vapor removing function is obtained by making the cross sectional area of these pipes such that the minimum cross sectional area of the inlet pipes is 1.5 to 3 times larger than the minimum cross sectional area of the outlet pipe, and the minimum diameter of the first inlet pipe connecting the upper portion of the reservoir tank to the outlet of the engine cooling water passageway is larger than or equal to that of the second inlet pipe connecting the upper portion of the reservoir tank to the inlet of the radiator.

During normal operating conditions, a main part of the water is recirculated between the engine and radiator, and the remaining part of the water is introduced into the reservoir tank via the inlet pipes, and an air-liquid separation process occurs in the reservoir tank whereby the vapor is discharged to the atmosphere via the relief valve, and the separated water is returned to the recirculating passageway via the inlet pipe.

During the hot soak condition, high pressure vapor collects at the upper portion of the engine cooling water passageway, which pushes down the level of the cooling water in the engine and causes a reverse flow of the cooling water in the inlet pipe, to thereby cause an overflow of the water in the reservoir tank. According to this embodiment, the relationship between the inner diameter of the pipes enables a difference of the flow resistances in the inlet and outlet pipes to be obtained, and thus a high pressure vapor in the engine is introduced into the reservoir tank via the inlet pipe having a lower flow resistance, and a reverse flow of the water is prevented by the outlet pipe having a higher flow resistance.

According to another embodiment, the vapor removing means comprises an arrangement such that the pipe connecting the upper portion of the reservoir tank to the outlet of the engine cooling water passageway has a length such that a minimum distance is formed therebetween. This minimum distance formed by the inlet pipe eliminates a vertical downward portion thereof, which normally allows an accumulation of the cooling water by which a smooth discharge of the vapor in the upper portion of the engine cooling water passageway is blocked. Also, the minimum distance formed by the inlet pipe allows a quick discharge of the vapor to the reservoir tank from the upper portion of the engine cooling water passageway.

According to still another embodiment, the vapor removing means comprise an arrangement such that the inlet pipe connecting the upper portion of the reservoir tank to the outlet of the engine cooling water passageway has a portion which runs vertically downward from the reservoir tank and a portion which is arranged alongside the main pipe connecting the radiator to the inlet of the engine cooling water passageway, and a float-type check valve is arranged in the outlet pipe and allows a flow of the cooling water only from the reservoir tank to the engine cooling water passageway. This float type check valve prevents a reverse flow of the water from the engine to the reservoir tank via the outlet pipe. Also, the high pressure of the vapor causes the vapor to be discharged while displacing the water accumulated in the portion of the inlet pipe running vertically downward from the bottom of the reservoir tank.

According to a further embodiment, the vapor removing means comprises an arrangement of the reservoir tank wherein partition walls are provided therein for dividing the inside thereof into a plurality of chambers, the partition walls defining communication holes for connecting the chambers with each other, an upper portion of one of the chambers being connected to the inlet pipe from the upper portion of the engine cooling water passageway, and another of the chambers being connected to the passageway to the outlet pipe. The partition construction of the reservoir tank prevents an instant introduction of the reverse flow of the water from the outlet pipe, due to the partitioning, when the relief valve or the inlet pipe is opened, and as a result of the effect of this delay, the vapor in the upper portion of the engine cooling water passageway is discharged to the reservoir tank via the inlet pipe, and thus a discharge of the cooling water from the relief valve is prevented.

DESCRIPTION OF THE PREFERRED EMBODIMENTS

Figure 1:
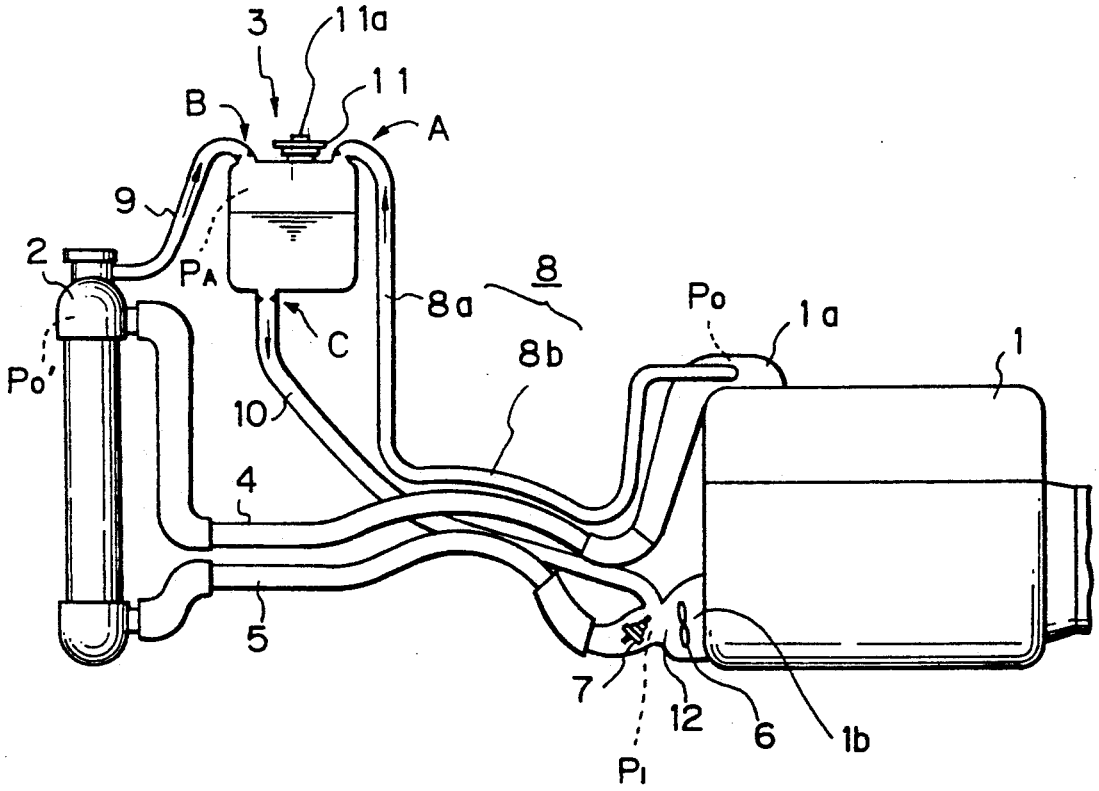
FIG. 1 is a diagrammatic view of the cooling system according to an embodiment of the present invention.

In FIG. 1, reference numeral 1 denotes a water-cooled internal combustion engine according to the present invention, 2 a radiator, and 3 a reserve tank. The engine 1 is provided with an inner cooling water passageway having an outlet 1*a* located at an upper portion of the engine and connected to an upper portion of the radiator 2 via a main pipe 4. The engine 1 is further provided with a cooling water pump 6 arranged in an inlet 1*b* for the cooling water located at the bottom of the engine 1. The water pump 6 is connected to the bottom portion of the radiator 2 via a main pipe 5, whereby a recirculating passageway for recirculating the cooling water is created by the engine inner cooling water passageway, the radiator 2, and the main pipes 4 and 5. A thermostat 7 is arranged in the pipe 5 at a position slightly upstream of the water pump 6. A reservoir tank 3 is connected to the upper cooling water outlet 1*a* via a first inlet pipe 8 for introducing a part of the cooling water including air or vapor into the reservoir tank 11, from the outlet 1*a*. When the engine is mounted on the vehicle, the pipe 8 has a portion 8*a* running vertically downward from the tank 3, and a portion 8*b* running alongside the pipes 4 and 5. The upper portion of the radiator 2 is connected to the upper portion of the reservoir tank 3 by a second inlet pipe 9, for introducing air and vapor from the radiator to the reservoir tank 3. The bottom of the reserve tank 3 is connected to the cooling water inlet of the engine via an outlet pipe 10, for returning the cooling water from the reservoir tank 3 to the inlet 1*b*. A removable cap 11, which is removed from the upper portion of the reservoir tank when supplementing the tank with cooling water, is provided with a relief valve 11*a* for discharging air or vapor in the tank 3 to the atmosphere, when the pressure inside the reservoir tank 3 becomes higher than a predetermined value.

A feature of this embodiment is that orifices A, B, and C are provided in the pipes 8, 9, and 10, respectively, and these orifices have inner diameters a, b, and c, respectively, having a predetermined relationship therebetween, as will be explained later.

The diameters a, b, and c of the orifices A, B, and C must be larger than a minimum value, for example, 3 mm, which will not allow a clogging thereof by particles such as dirt or rust. Nevertheless, the larger the diameters a, b, and c of the orifices A, B, and C, the smaller the amount of cooling water passed through the main recirculating passageway, i.e., the pipes 4 and 5, connecting the engine 1 and the radiator 2, which causes an increase of the amount of cooling water diverted to the reservoir tank 3. Therefore, to obtain a flow of a necessary amount of cooling water through the radiator 3, for cooling the engine, the diameters a, b, and c of the orifices A, B, and C must be smaller than a maximum value, for example, 12 mm.

Furthermore, the construction of the radiator 2 is such that the permissible pressure therein is limited, and therefore, the relief pressure of the relief valve 11*a* in the cap 11 must be set to a value matching the permissible pressure in the radiator 2, to prevent an excessive pressurization of the radiator 2 under the hot soak condition. Furthermore, the pressure $P_A$ inside the reserve tank 3 will reach the relief pressure under a high temperature load condition of the engine, but should not cause the pressure $P_O'$ in the upper portion of the radiator 2 to be become higher than the permissible pressure thereof, i.e., the relief pressure of the cap 11. Therefore, the total cross section $S_i$ of the inlet side orifices to the reservoir tank 3, A and B, must be 1.5 times larger than the opening area $S_o$ of the outlet side orifice C.

Nevertheless, if the total cross sectional area $S_i$ is 3 times larger than the cross sectional area $S_o$, the pressure at the upper side of the radiator $P_O'$ can be maintained at approximately the relief pressure, but the pressure $P_i$ at the inlet portion 12 of the cooling water pump 6 will be excessively lowered and cavitation will occur, which reduces the pumping efficiency and the amount of recirculated cooling medium, to thereby lower the cooling efficiency of the system. Therefore, the ratio $\alpha$ of the total cross sectional area $S_i$ to the cross sectional area $S_O$ ($S_i/S_o$) should satisfy the following equation, $$1.5<\alpha<3 \quad (1).$$

As a result, to explain a relationship between the inner diameters a, b, and c of the orifices A, B, and C, the following equation is obtained, $$1.5\leqq(a^2+b^2)/c^2\leqq 3 \quad (2).$$

The above-mentioned equation (1) can be obtained as explained below. Since the upper cooling water outlet 1a of the engine 1 and the upper portion of the radiator 2 are connected by the pipe 4, the pressures $P_O$ and $P_O'$ thereof have substantially the same value. Namely, it is considered that $P_O=P_O'$, and thus the total amount of fluid introduced into the reservoir tank, $Q_i$, becomes, $$Q_i = K \times S_i \times \sqrt{P_O - P_A}\,, \quad (3)$$

where K is a constant, and the amount of fluid from the reserve tank becomes, $$Q_o = K \times S_o \times \sqrt{P_A - P_i}\,. \quad (4)$$

Since the cooling system is completely sealed, $Q_i=Q_o$, and therefore, the following equation is obtained.

$$S_i/S_o = \sqrt{(P_A - P_i)/(P_O - P_A)} = \sqrt{\alpha^2}\,. \quad (5)$$

In view of the permissible pressure in the radiator and the cooling system, the following equation must be obtained with respect to the pressure of the reserve tank 3, i.e., the relief pressure $P_A$, $$P_o=1.1\times P_A \text{ to } 1.4\times P_A \quad (6),$$

and therefore, from the equation (5), the equation (6) becomes $$P_A-P_i=(0.1\times P_A \text{ to } 0.4\times P_A)\times\alpha^2$$

and accordingly, $$P_i=P_A-(0.1\times P_A \text{ to } 0.4\times P_A)\times\alpha^2 \quad (7).$$

To prevent cavitation, $P_i>0$ must stand, but when the engine is under a high speed condition, $P_i$ approaches zero, and therefore, the following equation can be obtained from the equation (7), $$\alpha^2=1/(0.1 \text{ to } 0.4),$$

and therefore, $$2.5<\alpha^2<10,$$

and thus the following equation, $$1.58<\alpha<3.16 \quad (8)$$

is obtained, which corresponds to the equation (1).

Figure 3:
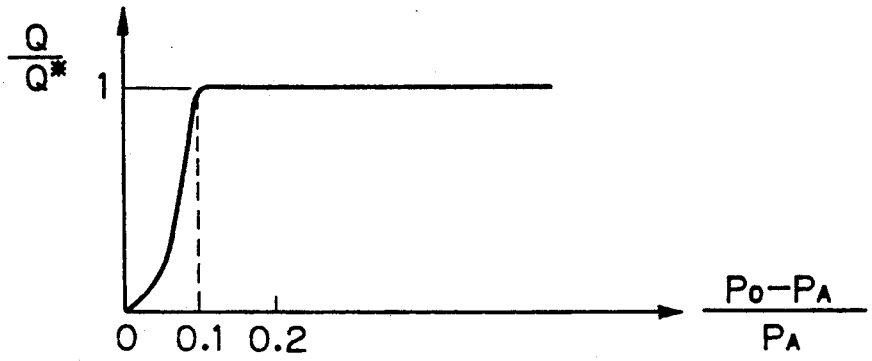
FIGS. 3 and 4 are graphs showing parameters indicative of characteristics of the cooling system.
Figure 4:
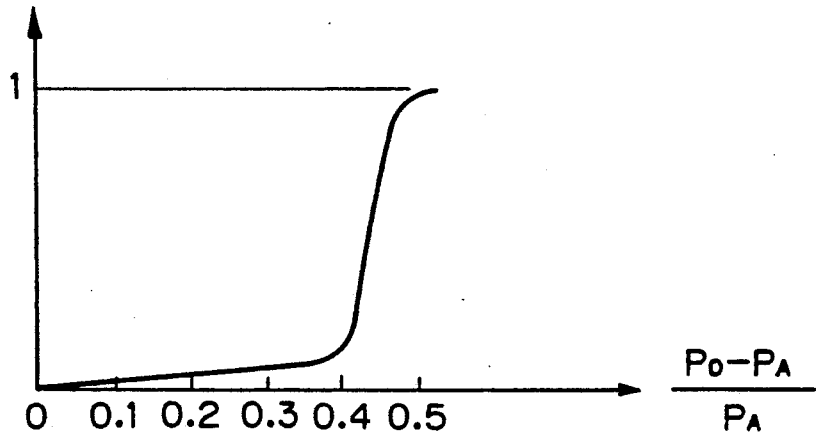

The above-mentioned equation (6) shows that if the inner diameters a, b, and c of the orifices A, B, and C, respectively, are between 3 mm to 12 mm, a characteristic as shown in FIG. 3 can be obtained, which represents a relationship of a ratio between the actual value Q and theoretical value Q* and the amount A of fluid recirculated in the reserve tank with respect to the ratio between the difference pressure $P_O-P_A$ and the relief pressure $P_A$. This means that, first, a sufficient flow amount cannot be obtained if the difference pressure value $P_O-P_A$ is larger than at least $0.1P_A$, and second, that the difference pressure value $P_O-P_A$ must be lower than $1.4P_A$, since a probability of a malfunction of the cooling device, such as detaching of coupling parts is, from experience, greatly increased when the value of $(P_O-P_A)/P_A$ exceeds 0.4, as shown by FIG. 4.

When the pipe 8 or 9 is not connected to the reserve tank, the value of a or b in the equation (2) is zero.

Furthermore, according to the embodiment of the present invention, the equation (2), i.e., $1.5\leqq(a^2+b^2)/c^2\leqq 3$, allows the pressure to fall below the permissible pressure but prevents cavitation.

Furthermore, when $a\geqq b$ and $a\geqq c$, a reverse flow of the cooling water is prevented, and accordingly, a loss of fluid due to such a reverse flow is prevented even under the condition of $a=b=c$. The flow of fluid into the reserve tank 3 via the pipe 9 passes through the inner cooling water passageway in the engine 1, the cooling water pump 6, the thermostat 7, the main pipe 5, and radiator 2, and the flow of fluid into the reserve tank 3 via the pipe 10 passes through the inner cooling water passageway in the engine 1 and the engine cooling water pump 6, and accordingly, there are no flow resistances to these flows other than those of the orifices B and C. Contrary to this, for the pipe 8, only the orifice A provides a main flow resistance, and therefore, even if $a=b=c$, the flow resistance via the pipe 8 becomes very low, which prevents a loss of the fluid due to a reverse flow thereof.

In the embodiment shown in FIG. 1, the orifices A, B, and C having the diameters a, b, and c, respectively, are specifically shown, but these specially made orifices in the pipes 8, 9 and 10 can be replaced by inlet or outlet passageways to the reserve tank 3, having minimum inner diameters, which correspond to a, b, and c, respectively.

According to the first embodiment shown in FIG. 1, the above-mentioned relationship between the values of the flow resistance of the pipes 8, 9, and 10 allows the high pressure vapor in the upper portion of the cooling water passageway in the engine during the hot soak condition to be easily sent to the reserve tank 3, and this vapor pushes down the level of the cooling water, to prevent a flow thereof out through the relief valve in the cap 11 of the reserve tank 3.

Figure 2:
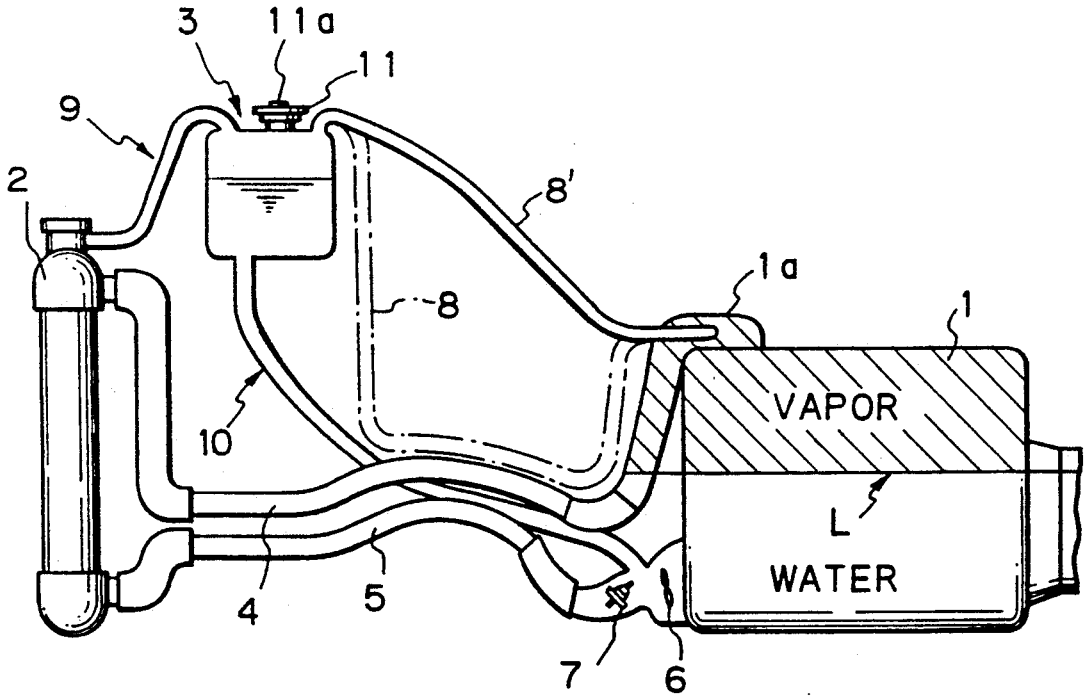
FIG. 2 is a diagrammatic view of the cooling system according to another embodiment of the present invention.

FIG. 2 shows a second embodiment of the present invention, wherein a pipe 8' connects the outlet 1*a* of the upper cooling water outlet to the reserve tank 3. This pipe 8' does not have a portion thereof descending vertically from the reserve tank, and therefore, connects the outlet 1*a* and the reserve tank 3 with a minimum distance therebetween. The prior art pipe construction as shown by a phantom line 8, has a portion thereof descending vertically from the reserve tank 3, in which portion the cooling water remains, and thus makes it difficult to evacuate the vapor under the hot soak condition. The vapor in the upper portion of the engine cooling water system can be exhausted after the vapor therein has pushed down the cooling water level L in FIG. 2 to the lowest portion of the pipe 8. This means that the cooling water pushed down by the vapor pressure in the engine is first introduced into the reserve tank 3 before the vapor is exhausted to the reserve tank 3, and as a result, the cooling water in the reserve tank 3 overflows to the outside via the cap 11 having the relief valve. The pipe 8*a* in this embodiment allows the vapor in the engine during the hot soak condition to be quickly exhausted to the reserve tank 3, and when the pressure in the reserve tank 3 exceeds the predetermined relief pressure, the vapor is discharged to the atmosphere via the relief valve 11*a*, which prevents a loss of a large amount of cooling water, which was inevitable in the prior art.

Figure 5:
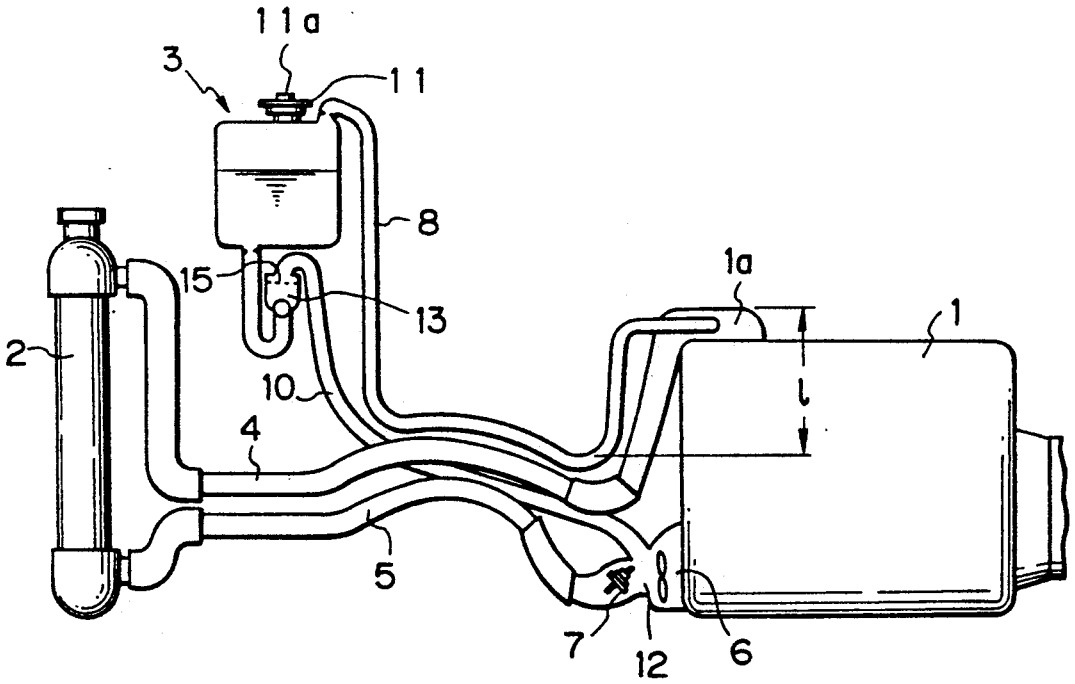
FIG. 5 a diagrammatic view of the cooling system according to a further embodiment of the present invention.
Figure 6:
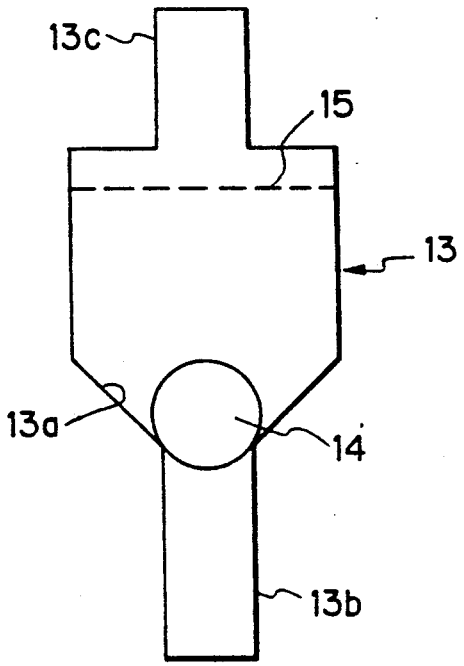
FIGS. 6 and 7 are enlarged elevational and cross sectional views of a part of FIG. 5.
Figure 7:
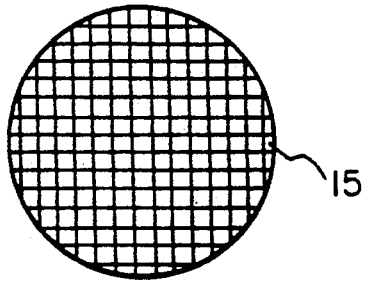

FIG. 5 shows a third embodiment of the present invention wherein, when compared with the first embodiment shown in FIG. 1, the pipe 1 is omitted and a float-valve type check valve 13 is provided. The check valve 13 comprises, as shown on an enlarged scale in FIG. 6, a float 14 seated on an inner tapered valve seat portion 13*a* and having a specific weight heavier than that of water, and a partition plate 15 made of a mesh material and located inside the valve body at a portion thereof opposite the valve seat portion 13*a*. The partition wall 15 (FIG. 7) prevents the upper inlet port 13*c* from being closed by the ball 14. The bottom inlet port 13*b* is connected to the bottom portion of the reservoir tank 3 as shown in FIG. 5, and the upper outlet portion 13*c* is connected through the inlet 12 to the cooling water pump 6. The pipe 8, as in FIG. 2, first vertically descends from the upper inlet 13*b* of the cooling water passageway for a distance 1, and then extends alongside the main water pipes 4 and 5.

In the embodiment shown in FIG. 5, under usual operating conditions, the flow of the cooling water from the reservoir tank 3 to the cooling water pump 6 via the pipe 10 is not blocked, but under the hot soak condition, the high pressure vapor stored in the cooling water passageway in the engine causes the cooling water therein to be urged downward, which causes a flow of the engine cooling water in the engine toward the reservoir tank 3. The reverse flow of the engine cooling water to the reservoir tank is prevented, however, since the float ball 14 of the check valve 13 is urged toward and seated on the valve seat portion 13*a*. The high pressure of the vapor held in the vertical descending portion of the pipe 8 displaces the water held therein, to thereby obtain a fluid-gas separation operation whereby only the vapor in the pipe 10 is discharged to the reservoir tank 3. Therefore, only the vapor is discharged to the atmosphere via the relief valve of the cap 11 when the pressure inside the tank 3 exceeds the predetermined relief pressure.

Figure 8:
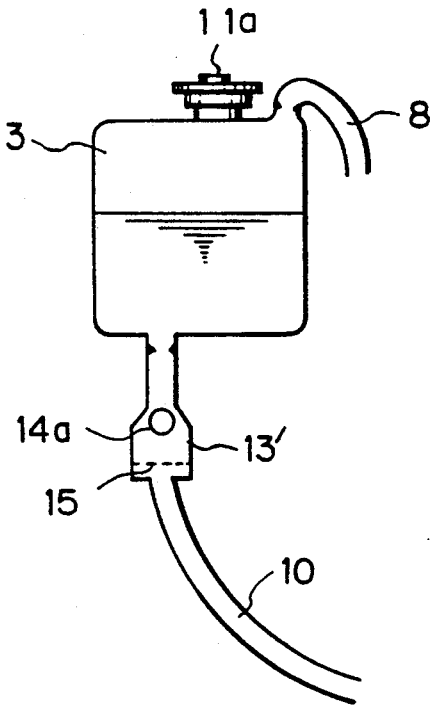
FIG. 8 is an enlarged view of a part of FIG. 6, indicating another embodiment of the present invention.

A modified embodiment is shown in FIG. 8, which employs a float ball 14*a* having a specific weight lighter than that of water. In this case, the bottom portion of the reservoir tank 3 in this embodiment is connected to the pipe 10 without once running upward as in the embodiment of FIG. 5. Therefore, the arrangement of the float 14*a* and the mesh plate 15 is reversed with respect to that of FIG. 5, so that only a flow of cooling water from the reservoir tank 3 is allowed, and therefore, a reverse flow to the reservoir tank 3 is prevented.

Figure 9:
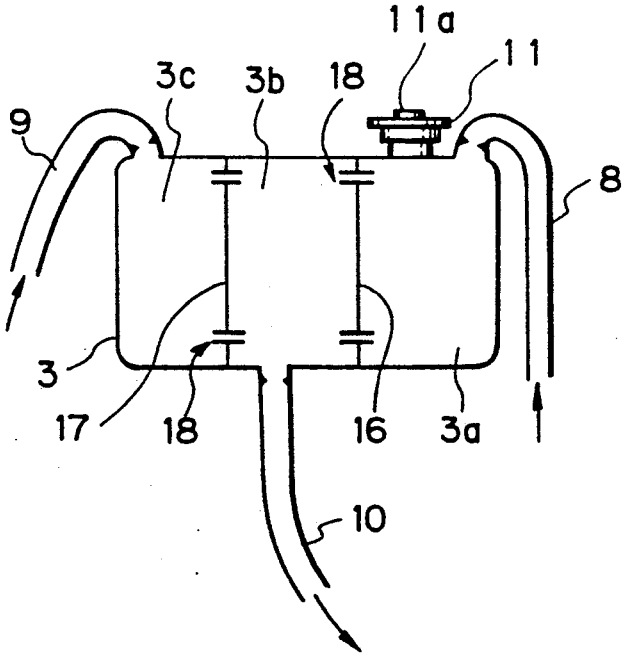
FIG. 9 is a partial view of a further embodiment of the present invention.

FIG. 9 shows a fourth embodiment of the present invention. As already explained, the reservoir tank 3 used for the first to third embodiments is made of a synthetic resin material, wherein partition walls 16 and 17 are provided as reinforcements, so that the space inside the tank 3 is divided into a plurality of small chambers 3*a*, 3*b*, and 3*c*, and the partition walls 16 and 17 form communication holes 18 for allowing the passage of the cooling water and the vapor. The fourth embodiment of the present invention attains the object of the present invention by using this divided construction of the reservoir tank 3. The pipe 8, which is connected to the upper inlet 1*a* of the engine cooling water passageway, is connected to the partition 3*a* at which the cap 11 with the relief valve is provided. The pipe 9 connected to the upper part of the radiator 2, and the pipe 10 connected to the inlet 12 of the cooling water pump 6, are connected to the partitions 3*c* and 3*b*, respectively. The partition construction of the reservoir tank 3 in this embodiment is used for separating these pipes 8, 9 and 10 in such a manner that there is no connection therebetween. It should be noted that both of the pipes 9 and 10 can be connected to the partition 3*c*.

In the embodiment of FIG. 9, grooves or slits in place of the holes 18 can be provided in the walls 16 and 17 for communication of the chambers 3*a*, 3*b*, and 3*c*.

In the operation of this embodiment, the high pressure vapor held in the upper portion of the cooling water passageway in the engine 1 during the hot soak condition pushes down the level of the cooling water in the engine, and thus a large amount of cooling water is introduced into the reserve tank. In this embodiment however, this water is first introduced into the partitions 3*b* and 3*c*, and is prevented from being instantly introduced into the partition 3*a*. Furthermore, a small amount of water is urged upward via the vertical portion of the pipe 8, and the partition 3*a* is prevented from being instantly filled by the water, whereby a free space is left in the upper part of the partition 3*a* which allows the vapor to be exhausted via the cap 11 through the relief valve. Namely, the pipe 8 cannot be blocked by the cooling water, and therefore, the excess vapor is exhausted to the reservoir tank. Accordingly, the vapor pressure in the engine 1, which otherwise would push down the cooling water level in the engine, is lowered, which prevents a flow of the engine cooling water out of the reservoir tank.

The above embodiments can attain the object of the present invention separately or when suitably combined, to further increase the efficiency of the cooling system.

The present invention is advantageous when the engine is inclined, i.e., is a slant type engine, wherein the inlet pipe between the engine cooling water outlet and the reservoir tank usually has a vertically descending portion, but the present invention is also effective for a non-slanting type engine, if provided with the vertically descending inlet pipe from the engine to the reservoir tank.

Although the above embodiments are described with reference to the attached drawings, many modifications and changes can be made by those skilled in this art without departing from the scope and spirit of the invention.

We claim:

1. A cooling system for an internal combustion engine, comprising:

a radiator having an inlet portion at a top portion and an outlet portion at a bottom portion thereof;

said engine being provided with an inner cooling water passageway having an inlet portion at a bottom portion and an outlet portion at a top portion thereof;

main pipes connecting said inlet portion and outlet portion of the inner cooling water passageway to the outlet portion and inlet portion of the radiator, respectively, to thereby create a recirculating passageway by which a recirculation of the cooling water between the radiator and the engine is ensured;

a reservoir tank for storing an amount of cooling water, said reservoir tank having at an upper portion thereof a relief valve for discharging vapor to the atmosphere;

inlet pipe means for introducing said cooling water into said reservoir tank from said recirculating passageway, and;

outlet pipe means for discharging said cooling water to said recirculating passageway from said reservoir tank;

said inlet and outlet pipe means having inner diameters of from 3 mm to 12 mm;

a minimum total cross section of said inlet pipe means being 1.5 to 3 timers larger than a minimum total cross section of said outlet pipe means.

2. A cooling system for an internal combustion engine, comprising:

a radiator having an inlet at a top portion and an outlet at a bottom portion thereof;

said engine being provided with an inner cooling water passageway having an inlet at a bottom portion and an outlet at a top portion thereof;

main pipes connecting said inlet and said outlet of the inner cooling water passageway to the outlet and inlet of the radiator, respectively, to thereby create a recirculating passageway by which a recirculation of the cooling water between the radiator and the engine is ensured;

a reservoir tank for storing an amount of cooling water for supplementing said engine cooling water recirculating line therewith, said reservoir tank having at an upper portion thereof a relief valve for discharging vapor to the atmosphere;

a first inlet pipe connecting the upper portion of the reservoir tank to the recirculating passageway at a position adjacent to the outlet of the engine inner cooling water passageway, and;

a second inlet pipe connecting the upper portion of the reservoir tank to the recirculating passageway at a position adjacent to said inlet to the radiator, and;

an outlet pipe connecting the lower portion of the reservoir tank to said recirculating passageway, which is located near the inlet to the engine inner cooling water passageway;

the inlet and outlet pipes having inner diameters of from 3 mm to 12 mm;

the minimum cross section of said inlet pipes being 1.5 to 3 times larger than the minimum cross section of the outlet pipe;

a minimum diameter of said first inlet pipe connecting the upper portion of the reservoir tank to the outlet of the engine cooling water passageway being larger than or equal to any other pipe connected to said reservoir tank.

3. A cooling system according to claim 2, wherein said reservoir tank is provided with partition walls therein for dividing the inside thereof into a plurality of chambers, the partition walls defining communication means for connecting the chambers with each other, an upper portion of one of the chambers being connected to the inlet pipe from the upper portion of the inner cooling water passageway, and another of the chambers being connected to the passageway to the outlet pipe.

4. A cooling system for an internal combustion engine, comprising:

a radiator having an inlet portion at a top portion and an outlet portion at a bottom portion thereof;

said engine being provided with an inner cooling water passageway having an inlet portion at a bottom portion and an outlet portion at a top portion thereof;

main pipes connecting said inlet portion and outlet portion of the inner cooling water passageway to the outlet portion and inlet portion of the radiator, respectively to thereby create a recirculating passageway by which a recirculation of the cooling water between the radiator and the engine is ensured;

a reservoir tank for storing an amount of cooling water for supplementing said engine cooling water recirculating line therewith, said reservoir tank having at an upper portion thereof a relief valve for discharging vapor to the atmosphere;

an inlet pipe connecting the upper portion of the reservoir tank to the recirculating passageway at a position adjacent to the outlet portion of the inner cooling water passageway, and;

an outlet pipe connecting the lower portion of the reservoir tank to said recirculating passageway, which is located near the inlet portion to the inner cooling water passageway;

said inlet pipe connecting the upper portion of the reservoir tank to the outlet portion of the inner cooling water passageway having a portion which vertically descends from the reservoir tank and a portion arranged alongside the main pipe connecting the radiator to the inlet portion of the engine cooling water passageway, and;

a check valve arranged in said outlet pipe, for allowing a flow of the cooling water only from the reservoir tank to the inner cooling water passageway.

5. A cooling system according to claim 4, said check valve is of a float type.

6. A cooling system for an internal combustion engine, comprising:

a radiator having an inlet at a top portion and an outlet at a bottom portion thereof;

said engine being provided with an inner cooling water passageway having an inlet at a bottom portion and an outlet at a top portion thereof;

main pipes connecting said inlet and outlet of the inner cooling water passageway to the outlet and inlet of the radiator, respectively, to thereby create a recirculating passageway by which a recirculation of the cooling water between the radiator and the engine is ensured;

a reservoir tank for storing an amount of cooling water for supplementing said engine cooling water recirculating line therewith, said reservoir tank having at an upper part thereof a relief valve for discharging vapor to the atmosphere;

an inlet pipe connecting the upper portion of the reservoir tank to the recirculating passageway at a position adjacent to the outlet of the engine cooling water passageway, and;

an outlet pipe connecting the lower portion of the reservoir tank to said recirculating passageway, which is located near the inlet to the engine inner cooling water passageway;

said reservoir tank being provided with partition walls therein for dividing the inside thereof into a plurality of chambers, the partition walls defining communication means for connecting the chambers with each other, an upper portion of one of the chambers being connected to the inlet pipe from the upper portion of the engine cooling water passageway, and another of the chambers being connected to the passageway to the outlet pipe.

7. A cooling system for an internal combustion engine, comprising:

a radiator having an inlet at a top portion and an outlet at a bottom portion thereof;

said engine being provided with an inner cooling water passageway having an inlet at a bottom portion and an outlet at a top portion thereof;

main pipes connecting said inlet and outlet of the inner cooling water passageway to the outlet and inlet of the radiator, respectively, to thereby create a recirculating passageway by which a recirculation of the cooling water between the radiator and the engine is ensured;

a reservoir tank for storing an amount of cooling water for supplementing said engine cooling water recirculation line therewith, said reservoir tank having at an upper portion thereof a relief valve for discharging vapor to the atmosphere;

at least one inlet pipe connecting the upper portion of the reservoir tank to the outlet of the engine cooling water passageway, said at least one inlet pipe comprising a portion which descends vertically from the reservoir tank and a portion which is arranged alongside the main pipe connecting the radiator to the inlet of the engine cooling water passageway, said at least one inlet pipe further comprising a check valve arranged in said outlet pipe for allowing a flow of the cooling water only from the reservoir tank to the engine cooling water passageway; and an outlet pipe connecting the lower portion of the reservoir tank to said recirculating passageway at a lower portion thereof;

wherein an arrangement including said at least one inlet passageway and said outlet pipe of said recirculating passageway at said upper portion and said lower portion respectively allow quickly removing a vapor pressure generated in the recirculation passageway to the atmosphere via a relief valve of the reservoir tank during an engine high temperature condition, to thereby prevent a reverse flow of the engine cooling water to the reservoir tank via the outlet pipe due to the vapor pressure in the recirculating passageway.

8. A system according to claim 7, said check valve is of a float type.

9. A cooling system for an internal combustion engine, comprising:

a radiator having an inlet at a top portion and an outlet at a bottom portion thereof;

said engine being provided with an inner cooling water passageway having an inlet at a bottom portion and an outlet at a top portion thereof;

main pipes connecting said inlet and outlet of the inner cooling water passageway to the outlet and inlet of the radiator, respectively, to thereby create a recirculating passageway by which a recirculation of the cooling water between the radiator and the engine is ensured;

a reservoir tank for storing an amount of cooling water for supplementing said engine cooling water recirculation line therewith, said reservoir tank having at an upper portion thereof, a relief valve for discharging vapor to the atmosphere;

first and second inlet pipes connecting the upper portion of the reservoir tank to the outlet of the engine inner passageway and the inlet of the radiator, wherein said arrangement of the diameter of the pipes is such that the minimum cross section of said inlet pipes is 1.5 to 3 times larger than the minimum cross section of the outlet pipe, and the minimum diameter of said first inlet pipe connecting the upper portion of the reservoir tank to the outlet of the engine cooling water passageway is larger than or equal to any other pipe connected to said reservoir tank; and an outlet pipe connecting the lower portion of the reservoir tank to said recirculating passageway at a lower portion thereof;

wherein an arrangement including said at least one inlet passageway and said outlet pipe of said recirculating passageway at said upper portion and said lower portion respectively allow quickly removing a vapor pressure generated in the recirculation passageway to the atmosphere via a relief valve of the reservoir tank during an engine high temperature condition, to thereby prevent a reverse flow of the engine cooling water to the reservoir tank via the outlet pipe due to the vapor pressure in the recirculating passageway.

10. A cooling system for an internal combustion engine, comprising:

a radiator having an inlet at a top portion and an outlet at a bottom portion thereof;

said engine being provided with an inner cooling water passageway having an inlet at a bottom portion and an outlet at a top portion thereof;

said pipes connecting said inlet and outlet of the inner cooling water passageway to the outlet and inlet of the radiator, respectively, to thereby create a recirculating passageway by which a recirculation of the cooling water between the radiator and the engine is ensured;

a reservoir tank for storing an amount of cooling water for supplementing said engine cooling water recirculation line therewith, said reservoir tank having at an upper portion thereof a relief valve for discharging vapor to the atmosphere;

at least one inlet pipe connecting the upper portion of the reservoir tank to an upper portion of the recirculating passageway;

an outlet pipe connecting the lower portion of the reservoir tank to said recirculating passageway at a lower portion thereof;

said reservoir tank having partition walls therein for dividing the inside thereof into a plurality of chambers, the partition walls defining communication means for connecting the chambers with each other, an upper portion of one of the chambers being connected to the inlet pipe from the upper portion of the engine cooling water passageway, and another of the chambers being connected to the passageway to the outlet pipe;

wherein an arrangement including said at least one inlet passageway and said outlet pipe of said recirculating passageway at said upper portion and said lower portion respectively allow quickly removing a vapor pressure generated in the recirculation passageway to the atmosphere via a relief valve of the reservoir tank during an engine high temperature condition, to thereby prevent a reverse flow of the engine cooling water to the reservoir tank via the outlet pipe due to the vapor pressure in the recirculating passageway.

* * * * *